US005957759A

United States Patent [19]

Cardenas et al.

[11] Patent Number: 5,957,759

[45] Date of Patent: Sep. 28, 1999

[54] SLURRY DISTRIBUTION SYSTEM THAT CONTINUOUSLY CIRCULATES SLURRY THROUGH A DISTRIBUTION LOOP

[75] Inventors: Jon Cardenas; Alexander P. Plevich; Timothy C. Kinsey, all of Austin, Tex.

[73] Assignee: Advanced Micro Devices, Inc., Sunnyvale, Calif.

[21] Appl. No.: 08/843,870

[22] Filed: Apr. 17, 1997

[51] Int. Cl.[6] ..... B24B 7/19; B24B 7/30

[52] U.S. Cl. ..... 451/60; 451/87; 451/88

[58] Field of Search ..... 451/41, 114, 28, 451/446, 60, 36, 53, 47, 99, 87, 88, 277

[56] References Cited

U.S. PATENT DOCUMENTS

| | | | |
|---|---|---|---|
| 2,613,482 | 10/1952 | Hamacher | 451/446 |
| 2,819,569 | 1/1958 | Angenieux | 451/446 |
| 3,162,986 | 12/1964 | Olivieri | 451/446 |
| 3,916,574 | 11/1975 | Prunier | 451/277 |
| 4,059,929 | 11/1977 | Bishop . | |
| 4,242,841 | 1/1981 | Ushakov et al. | 451/446 |
| 4,513,894 | 4/1985 | Doyle et al. | 222/644 |
| 4,784,295 | 11/1988 | Holmstrand | 451/446 |
| 4,851,113 | 7/1989 | Evans | 210/141 |
| 5,110,463 | 5/1992 | Yuichi et al. | 210/194 |
| 5,377,451 | 1/1995 | Leoni et al. | 451/287 |
| 5,407,526 | 4/1995 | Danielson et al. | 156/636 |
| 5,478,435 | 12/1995 | Murphy et al. | 156/636.1 |
| 5,516,327 | 5/1996 | Kawasaki | 451/60 |
| 5,538,462 | 7/1996 | Gnadt | 451/60 |
| 5,586,927 | 12/1996 | Herbert | 451/36 |
| 5,591,064 | 1/1997 | Spears, Jr. | 451/446 |
| 5,664,990 | 9/1997 | Adams et al. | 451/60 |

*Primary Examiner*—Timothy V. Eley
*Assistant Examiner*—Derris H. Banks
*Attorney, Agent, or Firm*—Skjerven, Morrill, MacPherson, Franklin & Friel, L.L.P.

[57] ABSTRACT

A slurry distribution system for distributing slurry to a polishing machine that polishes a semiconductor wafer is disclosed. The slurry distribution system includes a storage tank for storing the slurry, a mixing device for mixing the slurry in the storage tank, a distribution loop with an inlet and outlet in fluid communication with the storage tank, a valve in fluid communication with the distribution loop for dispensing the slurry to the polishing machine, and a pump for circulating the slurry from the storage tank through the distribution loop and into the storage tank regardless of whether the slurry is dispensed to the polishing machine. In this manner, the slurry is agitated and efficiently used during polishing and during intervals between polishing.

39 Claims, 2 Drawing Sheets

SLURRY DISTRIBUTION SYSTEM THAT CONTINUOUSLY CIRCULATES SLURRY THROUGH A DISTRIBUTION LOOP

BACKGROUND OF THE INVENTION

1. Field of the Invention

The present invention relates to slurry distribution systems, and more particularly to slurry distribution systems used with polishing machines in the manufacture of semiconductor wafers.

2. Description of Related Art

In the manufacture of integrated circuits, planarization of semiconductor wafers is becoming increasingly important as the number of layers used to form integrated circuits increases. For instance, metallization layers that provide interconnects between various devices may result in non-uniform surfaces. The surface nonuniformities may interfere with the optical resolution of subsequent photolithographic steps, leading to difficulty with printing high resolution patterns. The surface nonuniformities may also interfere with step coverage of subsequently deposited metal layers and possibly cause open or short circuits.

Various techniques have been developed to planarize the top surface of a semiconductor wafer. One such approach involves polishing the wafer using a polishing slurry that includes abrasive particles mixed in a suspension agent. With this approach, the wafer is mounted on a wafer holder, a polishing pad coated with the slurry is mounted on a platen, the pad and the wafer are rotated such that the wafer provides a planetary motion with respect to the pad, and the polishing pad is pressed against an exposed surface of the wafer with a hydrodynamic layer of the slurry therebetween. The polishing erodes the wafer surface, and the process continues until the wafer is largely flattened.

In chemical-mechanical polishing, the slurry includes a chemical that assists the abrasive particles in removing wafer material. Chemical-mechanical polishing has become a popular wafer planarization technique. For instance, chemical-mechanical polishing is becoming a preferred method of planarizing tungsten interconnects, vias and contacts, and with proper process parameters has shown significantly improved process windows and defect levels over standard tungsten dry etching.

Typically, the slurry is mixed in bulk by adding the abrasive particles and any additives, oxidizers, etchants and/or de-ionized water to the suspension agent. The slurry is then transported in containers to a slurry distribution system and deposited in a storage tank. The slurry distribution system pumps the slurry from the storage tank through delivery lines to a polishing machine as polishing occurs. It is desirable to provide a uniform distribution of the abrasive particles in the slurry in order to provide evenly polished surfaces. As a result, mixing devices are used to mix the slurry in the storage tanks in order to prevent large amounts of the abrasive particles from settling to the bottom of the storage tanks.

Polishing machines are operated with periodic intervals between polishing the semiconductor wafers. For instance, after a given wafer is polished, it is usually necessary to rinse the wafer with de-ionized water, remove it from the polishing machine, and secure another wafer to the polishing machine before polishing commences again. During intervals between polishing, when the slurry is not dispensed, it can remain stationary in the delivery lines, causing large amounts of the abrasive particles to settle to the bottom of the delivery lines. Thereafter, when polishing begins, and the slurry that had been stationary in the delivery lines is dispensed to the polishing machine, the uneven distribution of abrasive particles can lead to unevenly polished surfaces. Furthermore, the settled abrasive particles can clog the delivery lines.

This problem can be addressed by continuously dispensing the slurry to the polishing machine, or by flushing the stationary slurry out of the delivery lines without using it to assist with polishing. However, these approaches waste a considerable amount of slurry, which can be a significant cost burden in manufacturing.

Accordingly, a need exists for a slurry distribution system that efficiently provides agitated slurry to polishing machines.

SUMMARY OF THE INVENTION

The invention provides a slurry distribution system and its method of use that fulfills the need in the art described above.

In accordance with one aspect of the invention, a slurry distribution system that distributes slurry to a polishing machine that polishes a semiconductor wafer includes a storage tank for storing the slurry, a mixing device for mixing the slurry in the storage tank, a distribution loop with an inlet and outlet in fluid communication with the storage tank, a valve in fluid communication with the distribution loop for dispensing the slurry to the polishing machine, and a pump for circulating the slurry from the storage tank through the distribution loop and into the storage tank regardless of whether the slurry is dispensed to the polishing machine. In this manner, the slurry is agitated and efficiently used during polishing and during intervals between polishing.

Preferably, the slurry distribution system includes several valves in fluid communication with the distribution loop for dispensing the slurry to selected polishing machines, a pre-mix tank and a pre-mix device for initially mixing the slurry, and a pre-mix pump for pumping the slurry from the pre-mix tank into the storage tank. It is also preferred that the mixing device include a motor, a shaft and a propeller, such that the shaft extends diagonally into the storage tank, and the propeller faces and is coplanar with a sloped portion of a conically-shaped bottom surface of the storage tank.

The slurry distribution system is particularly well-suited for dispensing slurry to assist in chemical-mechanical polishing of a predominantly tungsten surface layer of a semiconductor wafer. Advantageously, the slurry distribution system can be highly compact and dispense well mixed slurry to a polishing machine near the storage tank without wasting excessive amounts of slurry and without requiring an operator to lift or pour the slurry.

These and other features of the invention will be further described and more readily apparent from a review of the detailed description of the preferred embodiments which follow.

BRIEF DESCRIPTION OF THE DRAWINGS

The following detailed description of the preferred embodiments can best be understood when read in conjunction with the following drawings, in which.

DETAILED DESCRIPTION OF THE PREFERRED EMBODIMENTS

Figure 1:
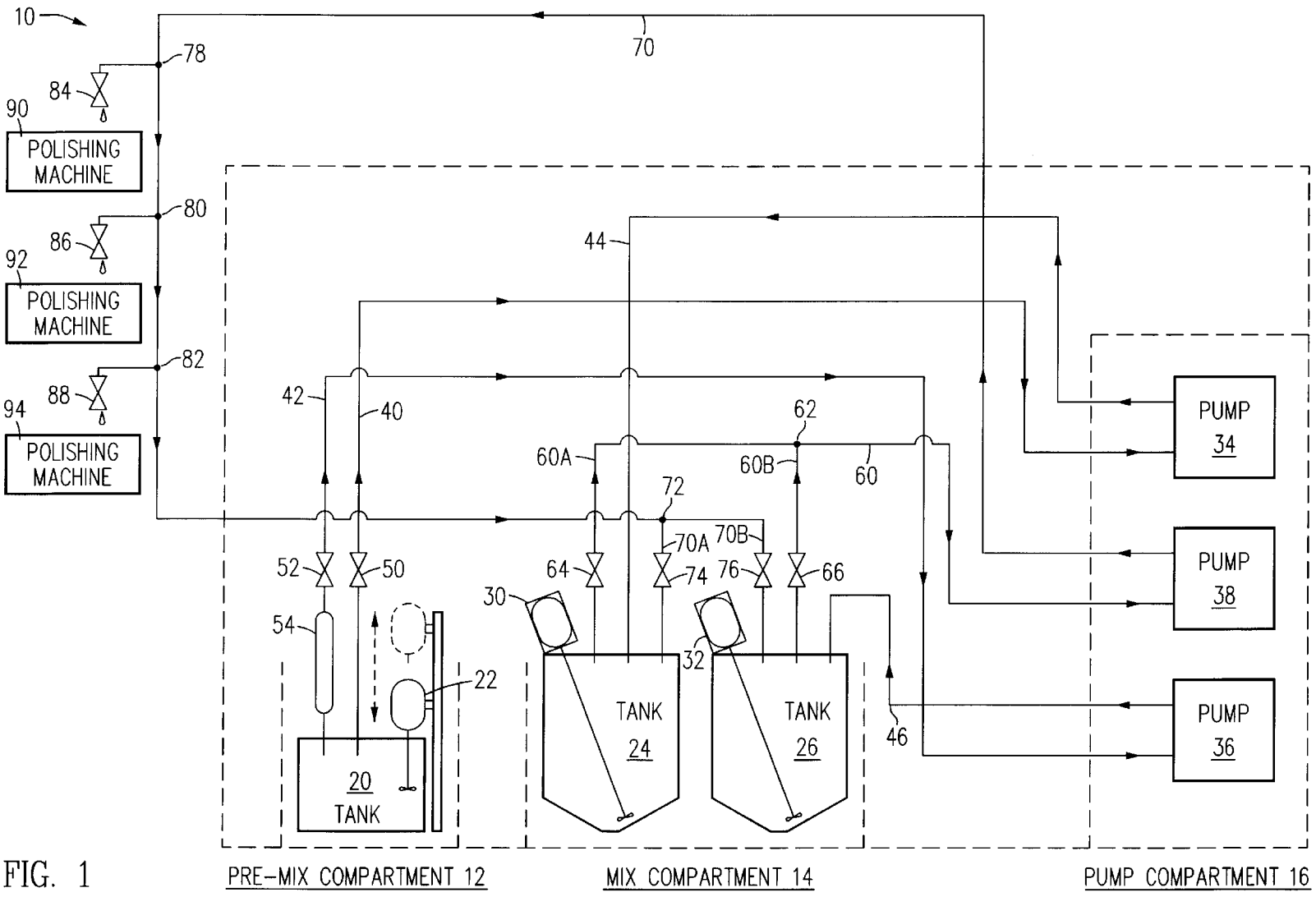
FIG. 1 shows a slurry distribution system according to an embodiment of the present invention.

In the drawings, depicted elements are not necessarily drawn to scale and like or similar elements may be designated by the same reference numeral throughout the several views.

FIG. 1 shows slurry distribution system 10 according to an embodiment of the present invention. System 10 includes pre-mix compartment 12, mix compartment 14 and pump compartment 16. Pre-mix compartment 12 is used for initially mixing the slurry, mix compartment 14 is used for storing and agitating the slurry as well as for supplying the slurry to and recovering the slurry from a distribution loop that dispenses the slurry to selected polishing machines, and pump compartment 16 is used for pumping the slurry through the system.

Pre-mix compartment 12 includes 5 gallon pre-mix tank 20 and vertically adjustable pre-mixing device 22. Mix compartment 14 includes 50 gallon storage tanks 24 and 26 and respective mixing devices 30 and 32. Since tanks 24 and 26 are larger than tank 20, mixing devices 30 and 32 are larger than mixing device 22. Pump compartment 16 includes pneumatically operated teflon transfer pumps 24 and 26 and distribution pump 38. Pumps 34, 36 and 38 are secured to respective shelves and can be replaced in a few minutes should problems develop.

Delivery lines 40 and 42 are disposed between tank 20 and pumps 34 and 36, respectively. Delivery lines 44 and 46 are disposed between pumps 34 and 36, respectively, and tanks 24 and 26, respectively. Delivery lines 40 and 42 include cutoff valves 50 and 52, respectively. Furthermore, delivery line 42 includes filter 54 for removing large particles.

Delivery line 60 is disposed between tank 24 and pump 38, and between tank 26 and pump 38. Delivery line 60 includes delivery line 60A with an inlet inside tank 24, and includes delivery line 60B with an inlet inside tank 26. Delivery lines 60A and 60B are dual paths coupled to the main artery at T-connector 62. Delivery line 60 also includes cutoff valves 64 and 66 in delivery lines 60A and 60B, respectively, in close proximity to storage tanks 24 and 26, respectively.

Delivery line 70 is disposed between tank 24 and pump 38, and between tank 26 and pump 38. Delivery line 70 includes delivery line 70A with an outlet inside tank 24, and includes delivery line 70B with an outlet inside tank 26. Delivery lines 70A and 70B are dual paths coupled to the main artery at T-connector 72. Delivery line 70 also includes cutoff valves 74 and 76 in delivery lines 70A and 70B, respectively, in close proximity to tanks 24 and 26, respectively.

Delivery line 70 further includes T-connectors 78, 80 and 82 in series between pump 38 and T-connector 72. T-connectors 78, 80 and 82 are in fluid communication with cutoff valves 84, 86 and 88, respectively.

Valves 50, 52, 64, 66, 74 and 76 either allow or prevent slurry flow through their respective delivery lines. That is, when these valves are opened they allow slurry flow through their respective delivery lines, whereas when these valves are closed they block slurry flow through their respective delivery lines. In either case, these valves are incapable of routing slurry away from their respective delivery lines.

Valves 84, 86 and 88 either allow or prevent slurry from being routed away from delivery line 70. That is, when these valves are opened they allow slurry flow both through and away from delivery line 70, whereas when these valves are closed they only allow slurry flow through delivery line 70. In either case, these valves are incapable of blocking slurry flow through delivery line 70.

It will be understood that opening valves 50, 52, 64, 66, 74 and 76 has the same affect on slurry flow as closing valves 84, 86 and 88, namely no appreciable affect whatsoever. On the other hand, closing valves 50, 52, 64, 66, 74 and 76 blocks slurry flow through delivery lines 40, 42, 60A, 60B, 70A and 70B, respectively, whereas opening valves 84, 86 and 88 creates a dual flow path both through and away from delivery line 70.

Valves 84, 86 and 88 are positioned directly above and in close proximity to polishing machines 90, 92 and 94, respectively. When valves 84, 86 and 88 are opened, they dispense slurry from their respective dispense points to underlying points of use at polishing machines 90, 92 and 94, respectively. Polishing machines 90, 92 and 94 include polishing pads on rotatable platens and include rotatable wafer mounts to which semiconductor wafers are removably secured in preparation for polishing, as is conventional. For illustration purposes, the semiconductor wafers include a predominantly tungsten surface layer that shall be planarized by chemical-mechanical polishing using the slurry dispensed from system 10.

The slurry is initially mixed in tank 20. For illustration purposes, the slurry is a conventional chemical-mechanical polishing slurry adapted for polishing tungsten, and is formed by mixing abrasive particles such as alumina, a ferric salt oxidizer such as ferric nitrate, a suspension agent such as propylene glycol, and deionized water in tank 20.

Figure 2:
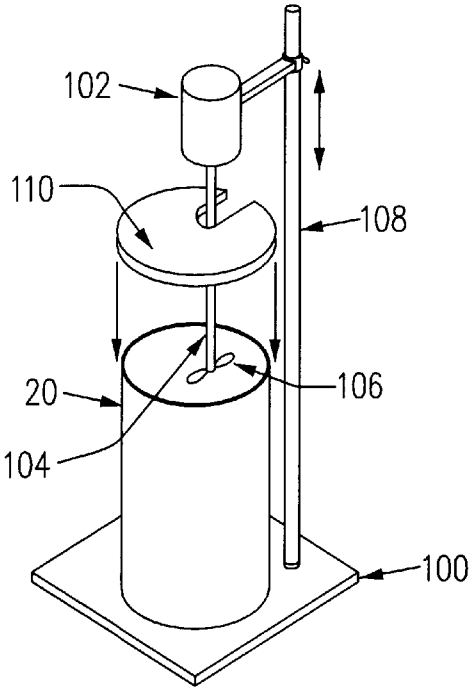
FIG. 2 shows an enlarged view of a pre-mix tank in the system of FIG. 1.

FIG. 2 shows an enlarged view of tank 20 without the delivery lines. Tank 20 is removably placed on base 100. Mixing device 22 includes mixing motor 102, shaft 104 and propeller 106, which are vertically adjustable along teflon coated steel shaft 108 by an operator using a polypropylene handle. Lid 110 for tank 20 includes an opening through which shaft 104 extends. When tank 20 is empty, lid 110 is removed, motor 102, shaft 104 and propeller 106 are raised vertically and locked in a fixed upper position, tank 20 is removed and replaced with another tank 20 that is filled with dry slurry chemicals, one or more liquids (such as deionized water) are poured into tank 20, then motor 102, shaft 104 and propeller 106 are vertically lowered and locked in a fixed lower position so that propeller 106 is inside tank 20 near the bottom of tank 20, and lid 110 is placed on tank 20. Thereafter, motor 102 is activated so that propeller 106 pre-mixes the slurry in tank 20. Advantageously, tank 20 need not be moved while the slurry is pre-mixed and pumped into a storage tank. As a result, the operator need not lift the slurry (thereby reducing injuries) or pour the slurry into another container (thereby reducing spills).

Returning to FIG. 1, the slurry in tank 20 is transferred to either tank 24 or tank 26. For illustration purposes, the slurry will be transferred to tank 24. Accordingly, valve 50 is opened, valve 52 is closed, pump 34 is activated, and pump 36 is deactivated. In this fashion, the slurry in tank 20 is pumped through the inlet of delivery line 40, through valve 50, through the remainder of delivery line 40 into pump 34, through pump 34 into delivery line 44, and through the outlet of delivery line 44 into tank 24. It will be understood that the slurry could be transferred to tank 26 in a similar manner.

Figure 3:
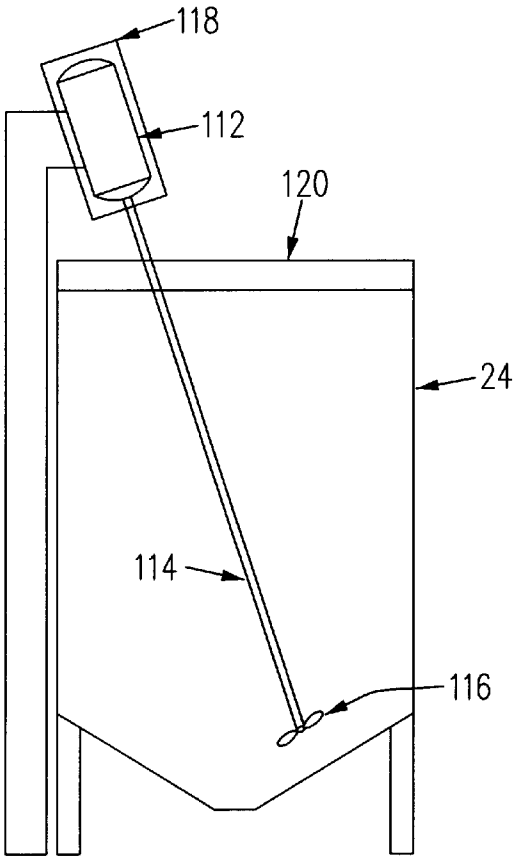
FIG. 3 shows an enlarged view of a storage tank in the system of FIG. 1.

FIG. 3 illustrates an enlarged view of tank 24 without the delivery lines. Tank 24 is permanently secured to a base. The slurry in tank 24 is mixed by mixing device 30 which includes mixing motor 112, shaft 114 and propeller 116. Motor 112 is located in a nitrogen purged cavity of housing 118. The nitrogen purge maintains a low pressure nitrogen atmosphere in the cavity. Lid 120 for tank 24 includes an opening through which shaft 114 extends. Shaft 114 extends diagonally into tank 24, and propeller 116 is inside tank 24 near the bottom of tank 24. Thus, shaft 114 and propeller 116 are in close proximity to opposite sidewalls of tank 24. Furthermore, the bottom of tank 24 has a conical shape that slopes downward towards a centrally located portion, and propeller 116 faces and is coplanar with a sloped portion of the bottom of tank 24. This arrangement improves mixing the slurry in tank 24. For instance, this arrangement creates a vortex that mixes the slurry throughout tank 24 while reducing separation and forming of the slurry. As such, this arrangement provides better mixing than if shaft 114 were to extend vertically into tank 24 with propeller 116 coplanar with the horizontal axis, as is conventional. Although not shown, an enlarged view of tank 26 is similar to that of tank 24.

Returning to FIG. 1, the slurry in tank 24 is circulated through a distribution loop that includes delivery lines 60 and 70. Suppose, for example, that the slurry need be dispensed only to polishing machine 92. In this instance, valves 64, 74 and 86 are opened, valves 66, 76, 84 and 88 are closed, and pump 38 is activated. As a result, the slurry in tank 24 is pumped through the inlet of delivery line 60A through delivery line 60 into pump 38, and through pump 38 into delivery line 70. A substantial amount of the slurry in delivery line 70 is dispensed by valve 86 to the point of use at polishing machine 92, although a substantial amount of the slurry in delivery line 70 flows past valve 86 and through the outlet of delivery line 70 back into tank 24.

It will be understood that the slurry can be provided to polishing machines 90 and 94 in a similar manner. In fact, the slurry can be dispensed to any combination of the polishing machines by appropriate use of valves 84, 86 and 88. For example, if valves 84, 86 and 88 are opened, then a substantial amount of the slurry in delivery line 70 is dispensed to the points of use at polishing machines 90, 92 and 94, although a substantial amount of the slurry in delivery line 70 flows past valves 84, 86 and 88 and through the outlet of delivery 70 back into tank 24.

When valves 84, 86 and 88 are closed, no appreciable amount of slurry remains stationary between T-connectors 78, 80 and 82 and valves 84, 86 and 88, respectively, and therefore the slurry that enters the inlet of delivery line 60A from tank 24 flows through the distribution loop and exits the outlet of delivery line 70 into tank 24. In this instance, even though none of the slurry is dispensed to any of the polishing machines, the slurry is continuously circulating and being agitated in both tank 24 and the distribution loop. Advantageously, when any of valves 84, 86 and 88 is subsequently opened to dispense slurry to polishing machines 90, 92 and 94, respectively, the dispensed slurry will have been circulating (as opposed to stationary) so that the abrasive particles are evenly mixed.

Pump 38 runs continuously to keep slurry circulating through the distribution loop, whereas pumps 34 and 36 run periodically to replenish tanks 24 and 26, respectively. Thus, pumps 34 and 36 run concurrently with pump 38. Furthermore, pumps 34 and 36 can replenish their respective storage tanks whether or not they are in fluid communication with the distribution loop. For instance, pump 34 can refill the slurry in tank 24 while pump 38 is pumping slurry from tank 24 through the distribution loop, or while pump 38 is pumping slurry from tank 26 through the distribution loop.

The multiple storage tanks allow system 10 to dispense different kinds of slurry without the need for purging and refilling a single storage tank each time a different kind of slurry is needed. For instance, a slurry adapted for chemical-mechanical polishing of tungsten can be pumped into tank 24 using pump 34, and a slurry adapted for chemical-mechanical polishing of copper can be pumped into tank 26 using pump 36. Suppose polishing machine 90 is ready to polish a wafer with a predominantly copper surface layer, and polishing machine 92 has just finished polishing a wafer with a predominantly tungsten surface layer. First, valves 64 and 86 are closed and valve 66 is opened while valve 74 remains opened and valves 76, 84 and 88 remain closed so that pump 38 can pump the vast majority of the tungsten polishing slurry in delivery lines 60 and 70 back into tank 24 before the leading front of the copper polishing slurry from tank 26 reaches valve 74. Thereafter, valve 74 is closed and valves 76 and 84 are opened while valves 64, 86 and 88 remain closed and valve 66 remains opened so that the copper polishing slurry circulates through the distribution loop and is dispensed to polishing machine 90 where polishing commences. Although a small amount of copper polishing slurry may be introduced into tank 24, and a small amount of tungsten polishing slurry may be introduced into tank 26, these amounts are small enough to have no appreciable affect on the slurries in these tanks. Likewise, the small amount of tungsten polishing slurry between T-connector 78 and valve 84 will have no appreciable affect on polishing machine 90.

Since the slurry receives more agitation in tanks 24 and 26 than in the distribution loop, it is desirable for slurry flowing through the outlets of delivery lines 70A and 70B, respectively, to be agitated in storage tanks 24 and 26, respectively, before it flows into the inlets of delivery lines 60A and 60B, respectively. This can be accomplished by positioning the inlet for delivery line 60A near the top of tank 24 and the outlet for delivery line 70A near the bottom of tank 24, or vice-versa; and similarly, by positioning the inlet for delivery line 62A near the top of tank 26 and the outlet for delivery line 72A near the bottom of tank 26, or vice-versa.

Preferably, pre-mix compartment 12, mix compartment 14 and pump compartment 16 are constructed with white chemical resistant polypropylene panels welded together at all seams, and are connected to drains (overflow and controlled) and an exhaust. It is also preferred that pump compartment 16 include electronic controls for operating the pumps.

Safety features for pre-mix compartment 12 and mixing compartment 14 include overflow drains, pneumatically operated mixing motors, and a constant down draft exhaust. The overflow drains remove spilled (possibly hazardous) fluids. The pneumatic operation of the mixing motors avoids sparks near the slurry. The down draft exhaust not only removes compressed dry air from the mixing motors, but also directs slurry vapor away from the mixing motors to reduce corrosion. Preferably, the down draft exhaust is supplied by a house exhaust system. A further safety feature for mixing compartment 14 is a nitrogen purge for the mixing motors. Safety features for pump compartment 16 include separate nitrogen purged compartments for each pump, and a leak detector coupled to an emergency shut down system with audio-visual alarms. The emergency shut down system controls a solenoid in the pneumatic line coupled to pump 38.

Pre-mix compartment 12 is not essential. Furthermore, pre-mix compartment 12 and mix compartment 14 may include any number of tanks, pump compartment 16 may include any number of pumps, and delivery line 70 may be in fluid communication with any number of valves for dispensing slurry to any number of polishing machines. For instance, pre-mix compartment 12 can include 2 pre-mix tanks, mix compartment 14 can include 3 storage tanks, pump compartment 16 can include 3 pumps (2 transfer pumps, 1 distribution pump) and delivery line 70 can be in fluid communication with 6 valves for dispensing slurry to 6 polishing machines.

Conventional slurry distribution systems often use 5 to 20 thousand gallon storage tanks in a chemical distribution building that supply slurry to polishing machines located in a wafer fabrication building. This requires the slurry to be pumped hundreds of feet from the storage tanks to the polishing machines. Pumping the slurry over such long distances can lead to separation and hardening of the slurry. Therefore, such conventional systems are not well-suited for recirculating the slurry back to the storage tank. In stark contrast, system 10 is a highly localized, compact system with relatively small (e.g., 50 gallon) storage tanks that can be located in the wafer fabrication building and relatively close (e.g., 50 to 75 feet) to the polishing machines. As a result, system 10 is far better suited for recirculating the slurry back to the storage tanks than larger conventional systems.

The valves in system 10 are controlled by manual operation, although it is possible to replace these valves with automatic valves controlled by a microcomputer.

Other aspects of system 10 will be apparent to those skilled in the art and need not be described in detail. For instance, the valves can be quarter-turn or multi-turn valves. Filter 54 is optional, and either filtered or unfiltered slurry can be delivered to the storage tanks. Additional delivery lines with cutoff valves can be coupled between an ultra-pure water loop and tanks 22, 24 and 26 to dilute the slurry in these tanks and to facilitate rinsing these tanks. Additional delivery lines with cutoff valves can also be coupled between the bottoms of tanks 24 and 26 and a drain to facilitate emptying these tanks. The delivery lines and pneumatic lines can include flexible tubes and/or metal pipes. For instance, delivery lines 42 and 44 can include flexible tubes with inlets extendable to a number of pre-mix tanks such as tank 20. Likewise, the pneumatic line connected to mixing device 22 should be flexible to facilitate vertical motion. In addition, slurry flow gauges and temperature monitors can be connected to various delivery lines, and pressure gauges and regulators can be connected to various pneumatic lines that provide compressed dry air to the pumps and mixing motors. Various other items of equipment can be connected to system 10, but are not shown for purposes of clarity. Of course, system 10 can be used in conjunction with any suitable slurry and polishing machine.

Other variations and modifications of the embodiments disclosed herein may be made based on the description set forth herein, without departing from the scope and spirit of the invention as set forth in the following claims.

What is claimed is:

1. A slurry distribution system for distributing slurry to a polishing machine that polishes a semiconductor wafer, the slurry distribution system comprising:

a storage tank for storing the slurry, wherein the storage tank includes a bottom surface with a conical shape that slopes towards a centrally located position, and the storage tank includes vertical sidewalls adjacent to the sloped portion of the bottom surface;

a mixing device for mixing the slurry in the storage tank, wherein the mixing device includes a propeller, the propeller is in the storage tank, and the propeller extends beneath the vertical sidewalls, the propeller facing and being coplanar with a sloped portion of a bottom surface of the storage tank;

a distribution loop with an inlet and outlet in fluid communication with the storage tank;

a valve in fluid communication with the distribution loop for dispensing the slurry to the polishing machine; and a pump for circulating the slurry through the distribution loop regardless of whether the slurry is dispensed to the polishing machine.

2. The slurry distribution system of claim 1, wherein the valve is proximate to the polishing machine, the valve dispenses the slurry to the polishing machine when the valve is opened, and the valve prevents dispensing the slurry to the polishing machine when the valve is closed.

3. The slurry distribution system of claim 1, wherein the pump circulates the slurry from the storage tank to the inlet, from the inlet to the outlet, and from the outlet to the storage tank regardless of whether the slurry is dispensed to the polishing machine.

4. The slurry distribution system of claim 1, wherein essentially all slurry that enters the inlet comes from the storage tank and flows through the outlet into the storage tank when the slurry is not dispensed to the polishing machine.

5. The slurry distribution system of claim 1, including a plurality of valves in fluid communication with the distribution loop for dispensing the slurry to a plurality of respective polishing machines.

6. The slurry distribution system of claim 1, including a pre-mix tank and pre-mix pump for pumping the slurry from the pre-mix tank into the storage tank to replenish the storage tank.

7. The slurry distribution system of claim 1, wherein the mixing device includes a motor and a shaft, the motor and propeller are coupled to opposite ends of the shaft, the shaft extends diagonally into the storage tank, and the propeller is near the bottom surface of the storage tank.

8. The slurry distribution system of claim 1, wherein the system continuously agitates the slurry in the storage tank and in the distribution loop regardless of whether the valve is opened for dispensing the slurry to the polishing machine or the valve is closed for preventing dispensing the slurry to the polishing machine.

9. The slurry distribution system of claim 1, wherein the polishing machine includes a rotatable polishing pad and a rotatable wafer holder, and the semiconductor wafer is removably secured to the wafer holder.

10. The slurry distribution system of claim 1, wherein the slurry includes abrasive particles, an oxidizing agent and a suspension agent, and the slurry is adapted for chemical-mechanical polishing of tungsten.

11. A slurry distribution system for distributing slurry to a plurality of polishing machines for polishing semiconductor wafers, the slurry distribution system comprising:

a storage tank for storing the slurry;

a mixing device for mixing the slurry in the storage tank, wherein the mixing device includes a motor, a shaft and a propeller, the motor and propeller are coupled to opposite ends of the shaft, the motor includes an external housing with a nitrogen purged cavity, the motor is outside the storage tank, the shaft extends through an opening in the housing and diagonally into the storage tank, and the propeller is near a bottom surface of the storage tank;

a distribution loop with an inlet and outlet in fluid communication with the storage tank, wherein the distribution loop excludes the polishing machines;

a plurality of valves in fluid communication with the distribution loop, wherein each of the valves are proximate to a respective point of use at a respective one of the polishing machines, each of the valves when opened dispenses the slurry to a respective one of the polishing machines, and each of the valves when closed prevents dispensing the slurry to a respective one of the polishing machines; and a pump for circulating the slurry from the storage tank to the inlet, from the inlet through the distribution loop to the outlet, and through the outlet to the storage tank regardless of whether the valves are opened or closed.

12. The slurry distribution system of claim 11, wherein essentially all of the slurry that enters the inlet comes from the storage tank and flows through the outlet into the storage tank when the valves are closed.

13. The slurry distribution system of claim 12, wherein each of the valves that is opened dispenses a substantial amount of the slurry to a respective one of the polishing machines.

14. The slurry distribution system of claim 11, wherein the system continuously agitates the slurry in the mixing tank and in the distribution loop regardless of whether the valves are opened or closed.

15. The slurry distribution system of claim 11, wherein the system includes a down draft exhaust that removes compressed dry air from the motor.

16. The slurry distribution system of claim 15, wherein the down draft exhaust directs slurry vapor away from the motor.

17. The slurry distribution system of claim 11, wherein the storage tank includes a cover, and the shaft extends through an opening in the cover.

18. The slurry distribution system of claim 11, wherein the bottom surface has a conical shape that slopes downward towards a centrally located portion, and the propeller faces and is coplanar with a sloped portion of the bottom surface.

19. The slurry distribution system of claim 11, including a removable pre-mix tank, a vertically adjustable pre-mix device for pre-mixing the slurry in the pre-mix tank, and a pre-mix pump for pumping the slurry from the pre-mix tank into the storage tank.

20. The slurry distribution system of claim 11, wherein the storage tank holds less than 100 gallons and is located less than 100 feet from the polishing machines.

21. A slurry distribution system for distributing slurry to a polishing machine, the slurry distribution system comprising:

a storage tank for storing the slurry, wherein the storage tank includes a bottom surface with a conical shape that slopes towards a centrally located position, and the storage tank includes vertical sidewalls adjacent to the sloped portion of the bottom surface;

a mixing device for mixing the slurry in the storage tank, wherein the mixing device includes a motor, a shaft and a propeller, the motor and propeller are coupled to opposite ends of the shaft, the motor is outside the storage tank, the shaft extends diagonally into the storage tank, the propeller is in the storage tank, and the propeller faces and is coplanar with a sloped portion of the bottom surface, and wherein the propeller extends beneath the vertical sidewalls;

a distribution loop with an inlet and outlet in fluid communication with the storage tank;

a valve in fluid communication with the distribution loop for dispensing the slurry to the polishing machine; and a pump for circulating the slurry through the distribution loop regardless of whether the slurry is dispensed to the polishing machine.

22. The slurry distribution system of claim 21, wherein the shaft and the propeller are in close proximity to opposite sidewalls of the storage tank.

23. The slurry distribution system of claim 21, wherein the motor includes an external housing with a nitrogen purged cavity, and the shaft extends through an opening in the housing.

24. The slurry distribution system of claim 21, wherein the slurry is adapted for chemical-mechanical polishing of tungsten.

25. A slurry distribution system for distributing slurry to a polishing machine, the slurry distribution system comprising:

a storage tank for storing the slurry;

a mixing device for mixing the slurry in the storage tank, wherein the mixing device includes a motor, a shaft and a propeller, the motor and propeller are coupled to opposite ends of the shaft, the motor includes an external housing with a purged cavity, the motor is outside the storage tank, the shaft extends through an opening in the housing and into the storage tank, and the propeller is in the storage tank;

a distribution loop with an inlet and outlet in fluid communication with the storage tank;

a valve in fluid communication with the distribution loop for dispensing the slurry to the polishing machine; and a pump for circulating the slurry through the distribution loop regardless of whether the slurry is dispensed to the polishing machine.

26. The slurry distribution system of claim 25, wherein the mixing device maintains a low pressure nitrogen atmosphere in the cavity.

27. The slurry distribution system of claim 25, wherein the motor is pneumatically operated.

28. The slurry distribution system of claim 25, wherein the shaft extends diagonally into the storage tank, and the propeller faces and is coplanar with a sloped portion of a bottom surface of the storage tank.

29. The slurry distribution system of claim 25, where the slurry is adapted for chemical-mechanical polishing of tungsten.

30. A slurry distribution system for distributing slurry to a polishing machine, the slurry distribution system comprising:

a first storage tank for storing a first slurry adapted for polishing a first material;

a second storage tank for storing a second slurry adapted for polishing a second material that is different than the first material;

a distribution loop with an inlet and outlet;

a first inlet valve for providing fluid communication between the inlet and the first storage tank;

a second inlet valve for providing fluid communication between the inlet and the second storage tank;

a first outlet valve for providing fluid communication between the outlet and the first storage tank;

a second outlet valve for providing fluid communication between the outlet and the second storage tank;

a dispense valve for dispensing slurry in the distribution loop to the polishing machine; and a distribution pump for circulating slurry in the distribution loop from the inlet to the outlet regardless of whether slurry in the distribution loop is dispensed to the polishing machine.

31. The slurry distribution system of claim 30, including the first slurry in the first storage tank and the second slurry in the second storage tank.

32. The slurry distribution system of claim 31, wherein the first slurry is adapted for chemical-mechanical polishing of tungsten and the second slurry is adapted for chemical-mechanical polishing of copper.

33. The slurry distribution system of claim 30, including a plurality of dispense valves for dispensing slurry in the distribution loop to a plurality of respective polishing machines.

34. The slurry distribution system of claim 33, wherein essentially all slurry that enters the inlet flow through the outlet when all the dispense valves are closed.

35. The slurry distribution system of claim 30, including:

a pre-mix tank;

a first transfer pump for pumping the first slurry from the pre-mix tank into the first storage tank; and a second transfer pump for pumping the second slurry from the pre-mix tank into the second storage tank.

36. The slurry distribution system of claim 35, including:

a first transfer valve for providing fluid communication between the pre-mix tank and the first transfer pump; and a second transfer valve for providing fluid communication between the pre-mix tank and the second transfer pump.

37. The slurry distribution system of claim 30, including:

a first mixing device for mixing the first slurry in the first storage tank, wherein the first mixing device includes a first motor, a first shaft and a first propeller, the first motor and the first propeller are coupled to opposite ends of the first shaft, the first shaft extends diagonally into the first storage tank, the first propeller is in the first storage tank, and the first propeller faces and is coplanar with a sloped portion of a bottom surface of the first storage tank; and a second mixing device for mixing the second slurry in the second storage tank, wherein the second mixing device includes a second motor, a second shaft and a second propeller, the second motor and the second propeller are coupled to opposite ends of the second shaft, the second shaft extends diagonally into the second storage tank, the second propeller is in the second storage tank, and the second propeller faces and is coplanar with a sloped portion of a bottom surface of the second storage tank.

38. The slurry distribution system of claim 30, including:

a first mixing device for mixing the first slurry in the first storage tank, wherein the first mixing device includes a first motor, a first shaft and a first propeller, the first motor and the first propeller are coupled to opposite ends of the first shaft, the first motor includes a first external housing with a purged nitrogen cavity, the first motor is outside the first storage tank, the first shaft extends through an opening in the first housing and into the first storage tank, and the first propeller is in the first storage tank; and a second mixing device for mixing the second slurry in the second storage tank, wherein the second mixing device includes a second motor, a second shaft and a second propeller, the second motor and the second propeller are coupled to opposite ends of the second shaft, the second motor includes a second external housing with a purged nitrogen cavity, the second motor is outside the second storage tank, the second shaft extends through an opening in the second housing and into the second storage tank, and the second propeller is in the second storage tank.

39. The slurry distribution system of claim 30, wherein the polishing machine includes a rotatable polishing pad and a rotatable wafer holder, and a semiconductor wafer is removably secured to the wafer holder.

* * * * *